United States Patent [19]

Darwent

[11] Patent Number: 4,608,144

[45] Date of Patent: Aug. 26, 1986

[54] ELECTRODE AND ELECTROLYTIC CELL

[75] Inventor: Brian J. Darwent, Cheshire, England

[73] Assignee: Imperial Chemical Industries PLC, London, England

[21] Appl. No.: 710,293

[22] Filed: Mar. 11, 1985

[30] Foreign Application Priority Data

Mar. 27, 1984 [GB] United Kingdom ..... 8407871

[51] Int. Cl.[4] ..... C25B 9/00; C25B 11/03; C25B 11/04

[52] U.S. Cl. ..... 204/257; 204/263; 204/284; 204/292; 204/293; 204/290 R

[58] Field of Search ..... 204/284, 255–256, 204/257–258, 283, 296, 263, 292, 293, 290 R

[56] References Cited

U.S. PATENT DOCUMENTS

| | | | |
|---|---|---|---|
| 3,242,065 | 3/1966 | De Nora et al. | 204/255 X |
| 3,361,656 | 1/1968 | Miller | 204/101 |
| 3,589,942 | 6/1971 | Leitz, Jr. et al. | 429/26 |
| 3,775,283 | 11/1973 | Eisele et al. | 204/255 X |
| 3,855,104 | 12/1974 | Messner | 204/283 X |
| 4,013,537 | 3/1977 | White | 204/256 |
| 4,057,479 | 11/1977 | Campbell | 204/258 |
| 4,062,756 | 12/1977 | Jha et al. | 204/301 |
| 4,210,512 | 7/1980 | Lawrance et al. | 204/257 |
| 4,233,147 | 11/1980 | Giacopell et al. | 204/283 X |
| 4,252,628 | 2/1981 | Boulton et al. | 204/257 |
| 4,402,811 | 9/1983 | Klotz et al. | 204/256 |
| 4,464,243 | 8/1984 | Woolhouse | 204/257 |

*Primary Examiner*—Donald R. Valentine

*Attorney, Agent, or Firm*—Cushman, Darby & Cushman

[57] ABSTRACT

An electrode comprising a base member having on at least one face thereof a plurality of first major channels closed at one end and provided at the other end thereof with means for feeding liquors thereto, a plurality of second major channels closed at one end and provided at the other end thereof with means for removing liquors therefrom, and a plurality of minor channels of smaller cross-section than the major channels and positioned between the first major channels and the second major channels and providing means for liquors to flow between the first major channels and the second major channels. Also, an electrolytic cell comprising such an electrode.

22 Claims, 6 Drawing Figures

ELECTRODE AND ELECTROLYTIC CELL

Figure 1:
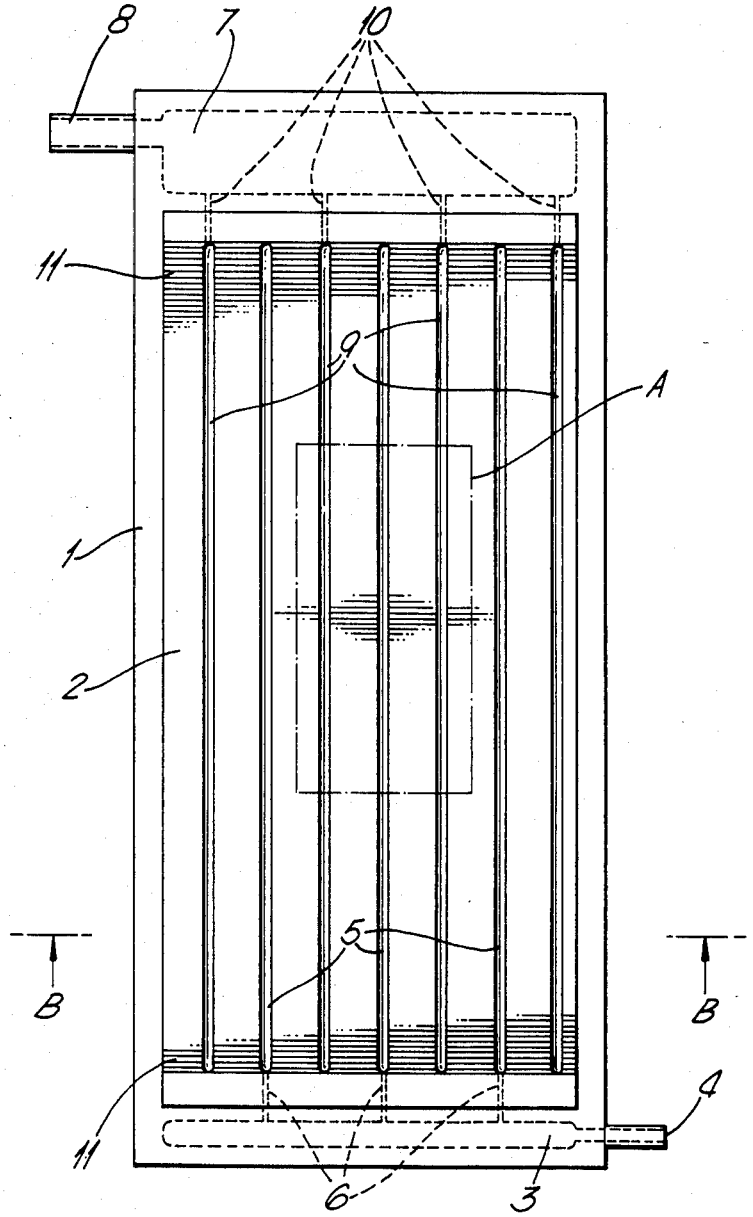

This invention relates to an electrode and to an electrolytic cell containing the electrode.

Electrolytic cells are known comprising an anode, or a plurality of anodes, and a cathode, or a plurality of cathodes, with each anode and adjacent cathode being separated by a separator which may be a hydraulically permeable diaphragm or a substantially hydraulically impermeable ion permselective membrane.

The anode compartments of such a cell are provided with means for feeding electrolyte to the cell, suitably from a common header, and with means for removing products of electrolysis from the cell. Similarly, the cathode compartments of the cell are provided with means for removing products of electrolysis from the cell, and optionally with means for feeding water or other fluid to the cell.

The separator in the electrolytic cell may be a hydraulically permeable diaphragm which permits electrolyte to flow from the anode compartments to the cathode compartments of the cell, or it may be a substantially hydraulically impermeable membrane which is ionically permselective, for example, cation permselective, and which permits selective flow of ionic species between the anode compartments and the cathode compartments of the cell.

Such electrolytic cells may be used for example in the electrolysis of water or aqueous solutions, e.g. in the electrolysis of aqueous alkali metal chloride solution. Where such a solution is electrolysed in an electrolytic cell of the diaphragm type the solution is charged to the anode compartments of the cell, chlorine which is produced in the electrolysis is removed from the anode compartments of the cell, the alkali metal chloride solution passes through the diaphragms and hydrogen and alkali metal hydroxide produced by electrolysis are removed from the cathode compartments, the alkali metal hydroxide being removed in the form of an aqueous solution of alkali metal chloride and alkali metal hydroxide. Where an aqueous alklai metal chloride solution is electrolysed in an electrolytic cell of the membrane type containing a cation permselective membrane the solution is charged to the anode compartments of the cell and chlorine produced in the electrolysis and depleted alkali metal chloride solution are removed from the anode compartments, alkali metal ions are transported across the membranes to the cathode compartments of the cell to which water or dilute alkali metal hydroxide solution may be charged, and hydrogen and alkali metal hydroxide solution produced by the reaction of alklai metal ions with hydroxyl ions are removed from the cathode compartments of the cell.

Electrolytic cells of the type described may be used particularly in the production of chlorine and sodium hydroxide by the electrolysis of aqueous sodium chloride solution.

The voltage at which such an aqueous solution may be electrolysed is made up of the sum of a number of elements, namely the theoretical electrolysing voltage, the over-voltages at the anode and cathode, and elements attributable to the resistance of the diaphragm or membrane positioned between the anode and cathode, the resistances of the metallic conductors and their contact resistances, and the resistance of the solution which is electrolysed.

In view of the high cost of electrical power it is desirable to reduce the voltage at which a solution is electrolysed at a given current density to as low a value as possible.

To this end it is desirable to reduce the resistance attributable to the solution which is electrolysed by making the gap between adjacent anodes and cathodes as small as possible. Ideally, the anode and cathode positioned on either side of the diaphragm or membrane may be in contact with a surface of the diaphragm or membrane, that is the electrolytic cell may be a so-called zero-gap cell.

However, in the case where gases are produced during the electrolysis, for example as in the case where hydrogen and oxygen are produced during the electrolysis of water or in the case where chlorine and hydrogen are produced during the electrolysis of aqueous alklai metal chloride solution, the gases tend to collect at the interface between the anode and/or the cathode and the diaphragm or membrane with the result that there is an increase in the resistance of the solution, and consequently an increase in the voltage of the electrolysis.

The present invention relates to an electrode which is so designed that in use in an electrolytic cell in which gases are produced during electrolysis, it results in rapid removal of the gases from the electrolytic cell.

According to the present invention there is provided an electrode comprising a base member having on at least one face thereof a plurality of first major channels closed at one end and provided at the other end thereof with means for feeding liquors thereto, a plurality of second major channels closed at one end and provided at the other end thereof with means for removing liquors therefrom, and a plurality of minor channels of smaller cross-section than said major channels and positioned between said first major channels and said second major channels and providing means for liquor to flow between said first major channels and said second major channels.

According to a further embodiment of the invention there is provided an electrolytic cell comprising an anode or a plurality of anodes, a cathode or a plurality of cathodes, and a separator positioned between and in contact with said anode(s) and or said cathode(s), the anode(s) or cathode(s) being in the form of an electrode as hereinbefore described.

Preferably both the anode(s) and cathode(s) are in the form of an electrode as hereinbefore described and preferably both are in contact with the separator in the electrolytic cell.

It is preferred that each of the first major channels and each of the second major channels are closed at one end thereof. The opposite open end of the major channels provides the means for feeding liquors thereto or the means for removing liquors therefrom, as the case may be.

Where the anode is in the form of an electrode as hereinbefore described use of the anode in an electrolytic cell enables flow of liquor through the anode compartment to be in a controlled manner, and in particular enables the direction of flow of the liquor to be controlled. Similarly, where the cathode is in the form of an electrode as hereinbefore described use of the cathode in an electrolytic cell enables flow of liquor through the cathode compartment to be in a controlled manner, and in particular enables the direction of flow of liquor to be controlled. Thus, in operation of the electrolytic cell electrolyte is charged to the anode compartments of the cell by feeding the electrolyte to the first major channels on the face of the anode. As these first major channels are closed at one end, and where the separator is in contact with the anode at least over a substantial part of the surface of the anode, electrolyte necessarily flows from the first major channels through the minor channels to the second major channels from which it flows out of the anode compartments. It can be appreciated that by means of this configuration of major and minor channels on the face of the anode a controlled flow of electrolyte is achieved over the face of the anode and thence out of the anode compartment. By means of this controlled, directed flow, gaseous products of electrolysis may readily be removed from the anode compartments of the electrolytic cell. In a similar manner, where the cathode is an electrode as hereinbefore described, the flow of liquor may be controlled and directed and gaseous products of electrolysis may readily be removed from the cathode compartments of the cell.

The base member is suitably in the form of a plate and the major and minor channels may be positioned on one face thereof, in which case the electrode may be used as a terminal electrode, or on both faces thereof, in which case the electrode may be an internal electrode positioned between terminal electrodes in the electrolytic cell.

The minor channels have a smaller cross-section than that of the major channels such that in use in an electrolytic cell there is a pressure drop across the minor channels between adjacent major channels thereby providing a good distribution of liquors through the channels over the surface(s) of the electrode.

At least some of the major channels and/or at least some of the minor channels are open lengthwise thereof so as to present an open lengthwise face to the separator which in the electrolytic cell is adjacent thereto and which may be in contact with the electrode.

The minor channels are open at both ends thereof in order to permit flow of liquor from the first major channels to the second major channels and may also be open lengthwise thereof so that the minor channels present an open lengthwise face to the separator which in the electrolytic cell is adjacent thereto and which may be in contact with the electrode.

Although the major channels are not necessarily open lengthwise of the channel it is preferred that they also present an open lengthwise face to the separator which in the electrolytic cell is in contact with the electrode.

The open channels may be in the form of a groove.

The major channels may be substantially parallel to each other and it is preferred that they are so arranged. When the electrode is installed in an electrolytic cell the major channels may be positioned substantially horizontally. However, it is preferred they they are positioned substantially vertically and that the means for feeding liquors to the first major channels is at or near the lower end of the electrode and that the means for removing liquors from the second major channels is at or near the upper end of the electrode.

The minor channels are positioned between and connect a first major channel and a second major channel adjacent thereto. The minor channels may be positioned substantially parallel to each other. Each first major channel may be connected to an adjacent second major channel or channels by means of a plurality of minor channels. Indeed, it is preferred that the number of minor channels which connect a first major channel and a second major channel adjacent thereto is substantial in order that there is a flow of liquor through the minor channels over a substantial area between adjacent major channels so that gases generated in the electrolysis may be efficiently removed from this area.

The first major channels and the second major channels may be positioned alternately on the face of the base member with a plurality of minor channels being positioned between the adjacent first major channels and second major channels. Thus, minor channels may connect a first major channel to two adjacent second major channels, and similarly minor channels may connect a second major channel to two adjacent first major channels.

The base member may be in the form of a plate with major and minor channels being positioned on at least one face of the plate. The base member is not necessarily in the form of a plate but this is a convenient form for the body member.

Major and minor channels may be positioned on two, opposite faces of the base member, e.g. on the two faces of a base member which is in the form of a plate.

The electrode may be a monopolar electrode or a bipolar electrode.

In the case of a monopolar electrode the major and minor channels may be positioned on one face or on two opposite faces of the base member. In the case where the major and minor channels are positioned on two faces of the base member the base member may be provided with means whereby liquor may pass from one side of the base member to the other provided this means is not such as to permit passage of a substantial amount of liquor directly between a first major channel on one side of the base member and a second major channel on the other side of the base member.

Liquor may be permitted to pass from one side of the base member to the other provided liquor passes between first major channels on opposite sides of the base member and/or between second major channels on opposite sides of the base member.

In the case of a bipolar electrode major and minor channels may be positioned on one, but are preferably positioned on two, opposite faces of the base member, one face of the base member serving as an anode and the other face of the base member as a cathode. In the case of a bipolar electrode there should be no means whereby liquor may pass from one side of the base member to the other.

The major channels may be formed for example by slots or grooves in the base member which present an open lengthwise face to the separator adjacent thereto, or the base member itself may have a wave-like profile, e.g. a sinusoidal profile, with the troughs of the waves providing the major channels and the peaks between the waves separating adjacent major channels. The minor channels may be slots or grooves positioned between major channels, e.g. between and connecting the slots or grooves forming the major channels. For example, where the base member has a wave-like profile, the minor channels may be slots or grooves positioned at the peaks of the waves separating adjacent major channels. An electrode having such a wave-like, e.g. sinusoidal profile provides the advantage that the actual operative surface area of the electrode, and of the separator, may be substantially in excess of the projected surface area of the electrode and of the separator.

When the electrode of the invention is installed in an electrolytic cell it is preferred that the major channels on the electodes which serve as anodes and the major channels on the electrodes which serve as cathodes are so positioned that that part of the anode which is between and which separates adjacent major channels on the anode is positioned opposite to and mates with a major channel on the cathode adjacent thereto. In this way the separator in the electrolytic cell which is positioned between adjacent anodes and cathodes may be held in position. Of course, that part of the anode which is between and which separates adjacent major channels on the anode should not be such as to fill the major channel on the cathode with which it mates. Similarly, it is preferred that in the electrolytic cell that part of the cathode which is between and which separates adjacent major channels on the cathode is positioned opposite to and mates with a major channel on the anode adjacent thereto.

It is within the scope of the invention for the minor channels to be positioned between and provide a direct connection, or an indirect connection, between a first major channel and a second major channel. Thus, minor channels may be positioned between and provide a direct connection between a first major channel and a second major channel adjacent thereto. Alternatively, minor channels may be positioned between and provide a connection between a first major channel and a major channel which is closed at both ends, and between the latter channel and a second major channel.

As the base member functions as an electrode it must be electrically conducting.

The electrode may be made of a metal or alloy which is electrically conducting, or at least have an outer surface of such a metal or alloy, the nature of the metal or alloy depending on the nature of the electrolyte which is to be electrolysed and on whether the electrode is to be used as an anode or a cathode. For example, where an aqueous solution of an alkali metal chloride is to be electrolysed and the electrode is to be used as an anode the electrode may suitably be made of, or at least have an outer surface of, a film-forming metal or alloy. The film-forming metal may be one of the metals titanium, zirconium, niobium, tantalum or tungsten or an alloy consisting principally of one or more of these metals and having anodic polarisation properties which are comparable with those of the pure metal. It is preferred to use titanium alone, or an alloy based on titanium and having polarisation properties comparable with those of titanium.

The anode may have a coating of an electro-conducting electro-catalytically active material. Particularly in the case where an aqueous solution of an alkali metal chloride is to be electrolysed this coating may for example consist of one or more platinum group metals, that is platinum, rhodium, iridium, ruthenium, osmium and palladium, or alloys of the said metals, and/or an oxide or oxides thereof. The coating may consist of one or more of the platinum group metals and/or oxides thereof in admixture with one or more non-noble metal oxides, particularly a film-forming metal oxide. Especially suitable electro-catalytically active coatings include platinum itself and those based on ruthenium dioxide/titanium dioxide, ruthenium dioxide/tin dioxide, and ruthenium dioxide/tin dioxide/titanium dioxide.

Where aqueous alkali metal chloride solution is to be electrolysed and the electrode is to be used as a cathode the electrode may suitably be made of or at least have an outer surface of, iron, copper or nickel. The surface of the cathode may be modified in order to reduce the hydrogen over-voltage of the surface of the cathode. Such modifications are well-known in the art.

The electrode may comprise a plastics material. As plastics materials are generally electrically non-conducting, and as the electrode must be electrically conducting, it follows that the plastics material must be modified in order to make it electrically conducting. Such modification may be achieved in a number of different ways. For example, plastics material may be filled with a substantial proportion of carbon black or graphite or particulate metal. It may comprise metallic fibre or non-metallic fibre having a coating of metal. The fibre may be randomly distributed throughout the plastics material. Alternatively, or in addition, the electrode may be in the form of a base member of a plastics material having one or more foraminate metal members embedded therein, e.g. in the form of a mesh, which may be woven or unwoven or in the form of an expanded metal. The embedded metal member may project from the surface of the base member and may act as a current distributor in the case where the anode or cathode is monopolar, in which case it may project from an edge of the plastics material in order to provide a means for electrical connection.

Where the electrode comprises a base member of a plastics material and a foraminate metal member embedded in and projecting from the surface thereof the foraminate metal member may be in a wavy form, the waves forming the first major channels and the second major channels, and the minor channels between adjacent major channels may be formed by the spaces between metal parts of the foraminate metal member at the peaks between the troughs of adjacent waves. Where the electrode is to be used as an anode the surface of the metal member may have an electro-conducting electro-catalytically active material of the type hereinbefore described. Where the electrode is to be used as a cathode the surface of the metal member may be modified in order to reduce the hydrogen overvoltage at the surface.

The plastics material may carry a metal layer on its face, for example a layer of a film-forming metal in the case of an anode, which may also have a layer of an electro-conducting electrocatalytically active material thereon, and a layer of nickel in the case of a cathode.

The plastics material may function as a bipolar electrode, in which case it conveniently may carry a layer of a film-forming metal on its anode face and a layer of nickel on its cathode face.

Where the electrode is a metal coated base member of a plastics material it is particularly suitable to use as the substrate an acrylonitrile-butadiene-styrene polymer material as such a material is readily metal coated, although other plastics materials may be used.

Where the electrode comprises a base member of a plastics material it is preferred that plastics material is so modified as to provide a base member having an electrical resistivity which is less than 0.1 ohm cm in the case of a bipolar electrode and which is less than 0.001 ohm cm in the case of a monopolar electrode.

The plastics material may be a polyolefin, for example, polyethylene, polypropylene, or an elastomeric polyolefin, e.g. an ethylene-propylene copolymer elastomer or an ethylene-propylene-diene copolymer elastomer. The plastics material may be a halogenated polyolefin, for example, polyvinyl chloride. Preferred halogenated polyolefins are fluorine-containing polyolefins, for example polyvinylidene fluoride, polyhexafluoropropylene, fluorinated ethylene-propylene copolymer, and particularly polytetrafluoroethylene, on account of the corrosion resistance of such fluorine-containing polyolefins. The plastics material may be an acrylonitrile-butadiene-styrene polymer.

Where the electrode of the invention is installed in an electrolytic cell the cell comprises a separator positioned between and in contact with adjacent anodes and cathodes.

Where the separator is a hydraulically permeable diaphragm it may be made of a porous organic polymeric material. Preferred organic polymeric materials are fluorine-containing polymers on account of the generally stable nature of such materials in the corrosive environment encountered in chlor-alkali electrolytic cells. Suitable fluorine-containing polymeric materials include, for example, polychlorotrifluoro-ethylene, fluorinated ethylenepropylene copolymer, and polyhexafluoropropylene. A preferred fluorine-containing polymeric material is polytetrafluoroethylene on account of its great stability in corrosive chlor-alkali electrolytic cell environments.

Such hydraulically permeable diaphragm materials are known in the art.

It is much preferred that the separator be an ion-exchange membrane capable of transferring ionic species between the anode and cathode compartments of an electrolytic cell, particularly one which is cation selective, as it is in an electrolytic cell containing such a membrane that the invention has its greatest applicability. Such ion-exchange materials are known in the art and are preferably fluorine-containing polymeric materials containing anionic groups. The polymeric materials preferably are fluorocarbons containing the repeating groups $$[C_mF_{2m}]_M \text{ and } [CF_2-\underset{\underset{X}{|}}{CF}]_N$$

where m has a value of 2 to 10, and is preferably 2, the ratio of M to N is preferably such as to give an equivalent weight of the groups X in the range 500 to 2000, and X is chosen from $$A \text{ and } [OCF_2-\underset{\underset{Z}{|}}{CF}\underset{P}{A}]$$

where p has the value of for example 1 to 3, Z is fluorine or a perfluoroalkyl group having from 1 to 10 carbon atoms, and A is a group chosen from the groups:

$-SO_3H$
$-CF_2SO_3H$
$-CCl_2SO_3H$
$-X^1SO_3H$
$-PO_3H_2$
$-PO_2H_2$
$-COOH$ and
$-X^1OH$ or derivatives of the said groups, where $X^1$ is an aryl group. Preferably A represents the group $SO_3H$ or —COOH. $SO_3H$ group-containing ion exchange membranes are sold under the tradename 'Nafion' by E. I. Du Pont de Nemours and Co. Inc. and —COOH group-containing ion exchange membranes under the tradename 'Flemion' by the Asahi Glass Co. Ltd.

The electrolytic cell may be of the filter press type and may comprise a large number of alternating anodes and cathodes, for example, fifty anodes alternating with fifty cathodes, although the cell may comprise even more anodes and cathodes, for example up to one hundred and fifty alternating anodes and cathodes.

In the electrolytic cell the electrodes may be positioned within and affixed to frame members of an electrically non-conducting material. The frame members may be made of plastics material as hereinbefore described.

Where the electrode comprises a base member of a plastics material the base member may be affixed to or be integral with a frame member of an electrically non-conducting plastics material.

The separator may be positioned between adjacent frame members to which electrodes are attached.

The frame members may be bonded to each other so as to provide a sealed electrolytic cell, for example by use of an adhesive, or by the use of solvent welding, heat welding or ultrasonic welding.

In general, bonding by means of adhesives may be effected with a wide variety of plastics materials of different types, for example, halogenated polyolefins, e.g. polyvinyl chloride, and plastics materials of the acrylonitrile-butadiene-styrene type. Of course, the nature of the adhesive will be selected for the particular plastics material which is to be bonded.

Thermal welding is a suitable means of effecting bonding of polyolefins, chlorinated polyolefins, e.g. polyvinyl chloride, and fluorine-containing polyolefins, and plastics materials of the acrylonitrile-butadiene-styrene type. Thermal welding may be effected for example, by positioning metallic wires, e.g. in the form of a tape, between adjacent frame members and applying pressure thereto. An electrical current may be passed through the wires to soften the plastics material and effect bonding.

The electrolytic cell is provided with means for feeding electrolyte, e.g. aqueous alkali metal chloride solution, to the first major channels of the anodes and thus to the anode compartments, and with means for removing products of electrolysis, e.g. chlorine and optionally depleted aqueous alkali metal chloride solution, from the second major channels of the anodes and thus from the anode compartments, and the electrolytic cell is provided with means for removing products of electrolysis, e.g. hydrogen and cell liquor containing alkali metal hydroxide from the second major channels of the cathodes and thus from the cathode compartments, and optionally, and if necessary, with means for feeding water or dilute alkali metal hydroxide solution to the first major channels of the cathodes and thus to the cathode compartments.

Although it is possible for the means for feeding electrolyte and for removing products of electrolysis to be provided by separate pipes leading to or from each of the respective anode and cathode compartments in the cell such an arrangement may be unnecessarily complicated and cumbersome, particularly in an electrolytic cell of the filter press type which may comprise a large number of such compartments. A preferred type of electrolytic cell comprises frame members of plastics material having a plurality of openings therein which in the cell define separate compartments lengthwise of the cell and through which the electrolyte may be charged to the cell, e.g. to the anode compartments of the cell, and through which the products of electrolysis may be removed from the cell, e.g. from the anode and cathode compartments of the cell. The compartments lengthwise of the cell may communicate with the anode compartments and cathode compartments of the cell via channels in the frame members.

Where the electrolytic cell comprises hydraulically permeable diaphragms there may be two or three openings which define two or three compartments lengthwise of the cell from which electrolyte may be charged to the anode compartments of the cell and through which the products of electrolysis may be removed from anode and cathode compartments of the cell.

Where the electrolytic cell comprises cation permselective membranes there may be four openings which define four compartments lengthwise of the cell from which electrolyte and water or other fluid may be charged respectively to the anode and cathode compartments of the cell and through which the products of electrolysis may be removed from the anode and cathode compartments of the cell.

The electrolytic cell may be operated at elevated pressure. Indeed it is preferred to charge electrolyte to the anode compartments of the cell at elevated pressure in order that the electrolyte may flow readily through the minor channels positioned between the first major channels and the second major channels.

Figure 2:
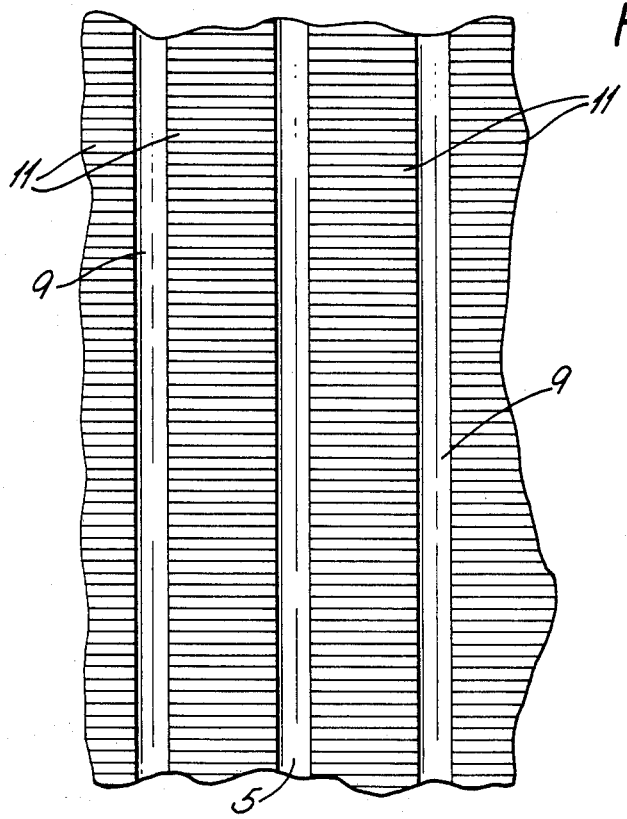
Figure 3:
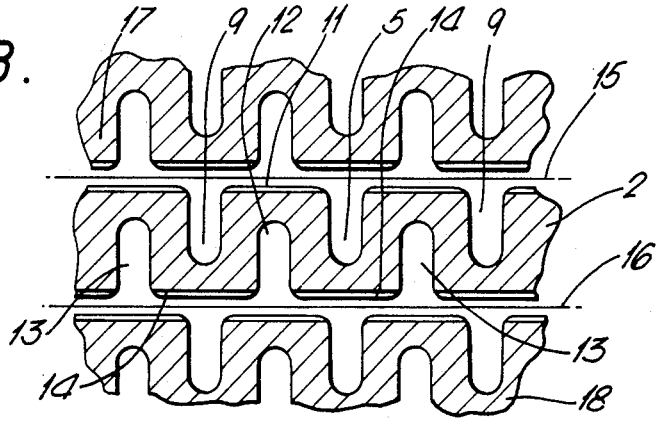
Figure 4:
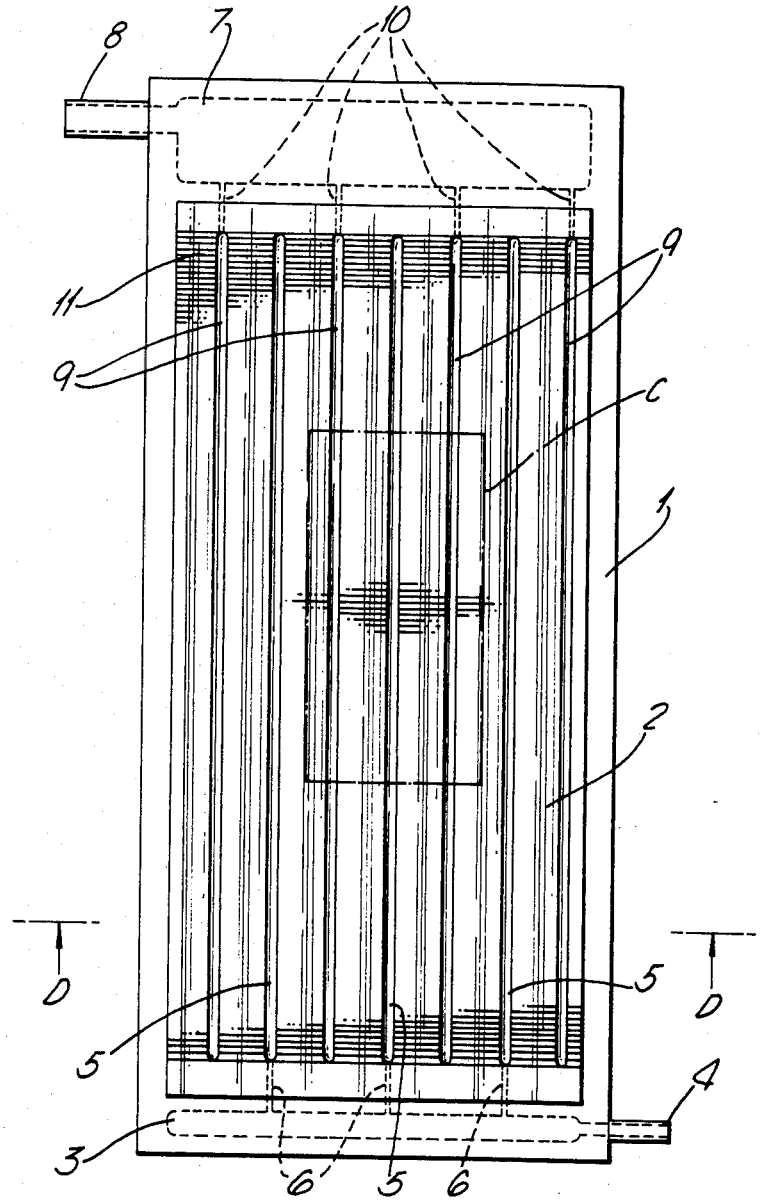
Figure 5:
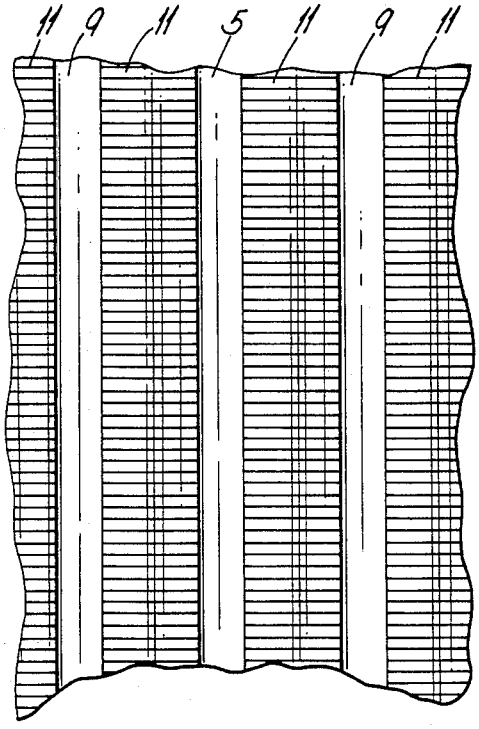
Figure 6:
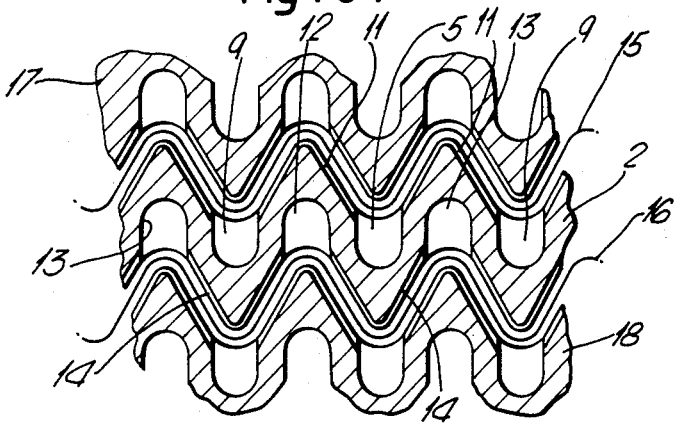

The invention will now be described with the aid of the following drawings in which FIG. 1 is a plan view of one face of a bipolar electrode, FIG. 2 is a plan view in an enlarged form of that part of the face of the electrode within the line A of FIG. 1, FIG. 3 is a cross-sectional view on the line B—B of FIG. 1 showing a part of the electrode of FIG. 1 when incorporated into an electrolytic cell, FIG. 4 is a plan view of one face of a different bipolar electrode, FIG. 5 is a plan view in an enlarged form of that part of the face of the electrode within the line C of FIG. 4, and FIG. 6 is a cross-sectional view on the line D—D of FIG. 4 showing a part of the electrode of FIG. 4 when incorporated into an electrolytic cell.

Referring to FIGS. 1 and 2, the bipolar electrode comprises a frame (1) of an electrically non-conducting plastics material, which in the present case is of an acrylonitrile-butadiene-styrene copolymer. Within the frame (1) and integral therewith there is positioned an electrode plate (2) which comprises a substrate of a plastics material, in this case an acrylonitrile-butadiene-styrene copolymer, which is filled with metal fibres, in this case of stainless steel, so that the electrode plate has a specific resistivity of less than 0.1 ohm cm.

The lower part of the frame (1) comprises a chamber (3) and a pipe (4) leading to the chamber (3). The electrode plate (2) comprises a plurality of openfaced first major channels (5) each of which is connected at one end to the chamber (3) via passageways (6) and each of which is closed at its opposite end. The upper part of the frame (1) comprises a chamber (7) and a pipe (8) leading to the chamber 7. The electrode plate (2) comprises a plurality of open-faced second major channels (9) which are parallel to the first major channels (5) and which are positioned alternately with the first major channels (5). Each of the second major channels (9) is connected at one end to the chamber (7) via passageways (10) and each is closed at its opposite end. The electrode plate comprises a plurality of open-faced minor channels (11) positioned at right angles to the major channels (5, 9) and each providing a fluid pathway between a first major channel (5) and the two second major channels (9) adjacent thereto.

In the embodiment of the electrode illustrated in FIGS. 1 and 2 there is shown one face only of the electrode, in this case the face which functions as an anode when the electrode is installed in an electrolytic cell. When viewed from the opposite side the electrode is identical with the view shown in FIG. 1, that is, it comprises a lower chamber and pipe (not shown) corresponding to those (3, 4) shown in FIG. 1, and an upper chamber and pipe (not shown) corresponding to those (7, 8) shown in FIG. 1. The opposite face of the electrode, which functions as a cathode when the electrode is installed in an electrolytic cell, also comprises a plurality of first major channels and passageways leading thereto, corresponding to the parts (5, 6), a plurality of second major channels and passageways leading therefrom corresponding to the parts (9, 10), and a plurality of minor channels corresponding to the minor channels (11). The embodiment illustrated in FIG. 3 shows the first major channels (12), the second major channels (13), and the minor channels (14) on the opposite, cathode face of the electrode.

Referring to FIG. 3, which illustrates a cross-sectional view of a part of an electrolytic cell there is shown a bipolar electrode plate (2) having on its anode face a plurality of first major channels (5) and second major channels (9), and a plurality of minor channels (11), and on its cathode face a plurality of first major channels (12) and second major channels (13), and a plurality of minor channels (14). The electrolytic cell comprises a cation-exchange membrane (15) in contact with the anode face of the electrode plate (2) and a cation-exchange membrane (16) in contact with the cathode face of the electrode plate (2). Also shown in FIG. 3 is the cathode face of another electrode plate (17) and the anode face of another electrode plate (18). The anode compartments of the electrolytic cell are formed by the major channels (5, 9) and minor channels (11), and the cathode compartments are formed by the major channels (12, 13) and the minor channels (14). In the electrolytic cell the cation-exchange membranes (15, 16) are sandwiched between frame parts (1) of adjacent electrodes. The pipes (4) of each electrode are joined to a header from which electrolyte may be taken and charged to the anode compartments of the electrolytic cell, and the pipes (8) of each electrode are joined to a header to which depleted electrolyte and products of electrolysis may be charged from the anode compartments of the electrolytic cell. Similarly, pipes (not shown) on each electrode are joined to a header from which water or other liquid may be taken and charged to the cathode compartments of the electrolytic cell, and pipes (not shown) on each electrode are joined to a header to which products of electrolysis may be charged from the cathode compartments of the electrolytic cell.

In the electrolytic cell the frames (1) of adjacent bipolar electrodes are sealed to each other by thermal welding, or the frames (1) may be sealed to each other by means of an adhesive. The electrolytic cell is completed by means of a terminal anode and a terminal cathode (not shown) connected to a suitable source of electrical power.

Operation of the electrolytic cell will be described by reference to the electrolysis of an aqueous solution of sodium chloride.

In operation, aqueous sodium chloride solution is charged to chamber (3) via pipe (4) from a header (not shown) and then via passageways (6) to first major channels (5) on the anode face of electrode plate (2). The aqueous sodium solution is electrolysed in the anode compartments of the electrolytic cell with the solution passing via minor channels (11) to the second major channels (9) and thence via passageways (10) to chamber (7). The products of electrolysis, that is chlorine and depleted aqueous sodium chloride solution flow from the chamber (7) via pipe (8) to the header (not shown). The flow of aqueous sodium chloride solution from first major channels (5) via minor channels (11) to second major channels (9) causes the gaseous product of electrolysis, chlorine, to be swept away from the anode face of the electrode in an efficient manner.

In a similar manner water is charged from a header (not shown) to the cathode compartments of the cell and is electrolysed therein. The water, and the products of electrolysis, namely hydrogen and sodium hydroxide formed by reaction of hydroxyl ions with sodium ions transported across the cation-exchange membranes from the anode compartments to the cathode compartments, flow from first major channels (12) via minor channels (14) to second major channels (13) and thence to the header (not shown).

The embodiment illustrated in FIGS. 4 to 6 is similar to that illustrated in FIGS. 1 to 3. Like parts therein are indicated by the same numerals. The embodiments differ in that in the electrode and electrolytic cell illustrated in FIGS. 4 to 6 the electrode plate (2) has a wave-like shape.

I claim:

1. An electrode comprising a base member having on at least one face thereof a plurality of first major channels closed at one end and provided at the other end thereof with means for feeding liquors thereto, a plurality of second major channels closed at one end and provided at the other end thereof with means for removing liquors therefrom, and a plurality of minor channels of smaller cross-section than said major channels and positioned between said first major channels and second major channels and providing means for liquor to flow between said first major channels and said second major channels.

2. An electrode as claimed in claim 1 in which each of said first major channels and each of said second major channels are closed at one end thereof.

3. An electrode as claimed in claim 1 or claim 2 in which the base member is in the form of a plate having major and minor channels on one face thereof.

4. An electrode as claimed in claim 1 or claim 2 in which the base member is in the form of a plate having major and minor channels on both faces thereof.

5. An electrode as claimed in claim 1 in which at least some of the major channels and/or at least some of the minor channels are open lengthwise thereof so as to present an open face lengthwise thereof.

6. An electrode as claimed in claim 5 in which all of the minor channels are open lengthwise thereof so as to present open faces lengthwise thereof.

7. An electrode as claimed in claim 5 or claim 6 in which all of the major channels are open lengthwise thereof so as to present open faces lengthwise thereof.

8. An electrode as claimed in claim 1 in which the major channels are substantially parallel to each other.

9. An electrode as claimed in claim 1 in which the minor channels are positioned substantially parallel to each other.

10. An electrode as claimed in claim 1 in which each first major channel is connected to at least one adjacent second major channel by means of a plurality of minor channels.

11. An electrode as claimed in claim 1 in which the electrode has a wave-like profile in which the troughs of the wave-like profile provide the major channels and the peaks of the wave-like profile separate adjacent major channels.

12. An electrode as claimed in claim 11 in which the minor channels are slots or grooves positioned at the peaks of the wave-like profile.

13. An electrode as claimed in claim 1 or 12 in which the electrode is made of a metal or alloy or has an outer surface of a metal or alloy.

14. An electrode as claimed in claim 1 or claim 13 in which the electrode comprises a plastics material.

15. An electrolytic cell, comprising:

at least one anode;

at least one cathode; and a separator positioned between and separating from a said cathode each said anode which adjoins a respective said cathode;

at least one of said anode and cathode being provided as an electrode comprising:

a base member having on at least one face thereof a plurality of first major channels closed at one end and provided at the other end thereof with means for feeding liquors thereto;

a plurality of second major channels closed at one end and provided at the other end thereof with means for removing liquors therefrom; and a plurality of minor channels of smaller cross-section than said major channels and positioned between said first major channels and second major channels and providing means for liquor to flow between said first major channels and said second major channels.

16. An electrolytic cell as claimed in claim 15, in which:

said electrolytic cell includes means for feeding liquors to said first major channels and means for removing liquors from said second major channels; and the said electrode is so positioned in an electrolytic cell that:

said major channels are positioned substantially vertically, said means for feeding liquors to said first major channels is at or near the lower end of said electrode, and said means for removing liquors from the second major channels is at or near the upper end of said electrode.

17. An electrolytic cell as claimed in claim 16, in which: said electrode has a wave-like profile in which the troughs of the wave-like profile provide the major channels and the peaks of the wave-like profile separate adjacent major channels.

18. An electrolytic cell as claimed in claim 17, in which:

said minor channels are provided in the form of slots or grooves connecting troughs across peaks of said wave-like profile.

19. An electrolystic cell as claimed in claim 18 in which said electrode is provided with a metallic outer surface on a core of plastics material.

20. An electrolytic cell as claimed in any one of claims 15, 16, 17, 18 or 19 in which:

each said anode and each said cathode is provided in the form of a said electrode.

21. An electrolytic cell as claimed in claim 20 in which the major channels on the electrodes which serve as anodes and the major channels on the electrodes which serve as cathodes are so positioned that that part of the anode which is between and which separates adjacent major channels on the anode is positioned opposite to and mates with a major channel on the cathode adjacent thereto.

22. An electrolytic cell as claimed in claim 21 in which the separator is an ion-exchange membrane.

* * * * *